United States Patent [19]

Anagnostopoulos

[11] Patent Number: 5,042,280

[45] Date of Patent: Aug. 27, 1991

[54] MACHINE FOR STRAIGHTENING METALLIC BARS OR RODS OR WIRES OR TUBES

[76] Inventor: Panayotis A. Anagnostopoulos, 1, Velissarious str., 155 62 Holargos, Athens, Greece

[21] Appl. No.: 507,222

[22] Filed: Apr. 11, 1990

[51] Int. Cl.[5] ..... B21D 3/06

[52] U.S. Cl. ..... 72/70; 72/79; 140/140

[58] Field of Search ..... 140/140; 72/78, 79, 72/70; 83/157, 167; 414/745.1; 209/933, 517; 100/7

[56] References Cited

U.S. PATENT DOCUMENTS

| | | | |
|---|---|---|---|
| 613,754 | 11/1898 | Brightman | 72/78 |
| 1,732,224 | 10/1929 | Danziger | 140/140 |
| 2,007,345 | 7/1935 | Roberts | 140/140 |
| 3,100,519 | 8/1963 | Johnston | 72/78 |
| 4,436,471 | 3/1984 | Koehler | 414/745.1 |

*Primary Examiner*—Lowell A. Larson

*Attorney, Agent, or Firm*—Cushman, Darby & Cushman

[57] ABSTRACT

A straightening apparatus for metallic bars, rods, wires, tubes and the like is provided which includes a rotor which is adapted for being rotated about a longitudinal axis thereof. At least three rollers are mounted to the rotor body and are clearly rotatable about their respective axis. A bar which is to be straightened passes along the axis of the rotor. The rollers are alternately disposed on either side of the rotor axis so as to sequentially engage the bar to be straightened. The rollers are mounted so as to be pivotal so that the plane of each roller can be pivoted with respect to a plane passing through the axis of the rotor. When the rotor is rotated, the bar to be straightened is urged along the axis of the rotor due to friction between the surface of the rollers and the surface of the bar. At the same time, the rollers straighten the bar. A flying cutter is preferably provided down stream of the bar straightening rotor, and furthermore, a cut bar collector is preferably provided for collecting bars cut by the flying cutter.

11 Claims, 8 Drawing Sheets

MACHINE FOR STRAIGHTENING METALLIC BARS OR RODS OR WIRES OR TUBES

SUMMARY OF THE INVENTION

The rotor is a straightening apparatus for metallic bars (or rods, or wires, or tubes), that comprises a rotor and at least three rollers that are located on the rotor body and rotate freely with respect to their respective shaft. The bar that must be straightened passes along the axis of the rotor.

As used herein "Roller Plane" is a plane that is perpendicular to the roller shaft. As used herein the "meridian plane" of the rotor is a plane that contains the axis of rotation of the rotor.

The rollers are divided into two groups, initially their planes lying on a meridian plane, one group or rollers located on each side of the rotor axis.

The position of each roller of one group is in the middle of two rollers of the opposite group. By different mechanical means the rollers can move up and down with respect to the rotor axis and also the roller planes can be rotated with respect to the meridian planes as well.

As the rotor is forced to rotate (by a separate motor) with a bar along its axis and with the rollers pressing the bar, the roller planes being turned to certain angle (the same for all the rollers) with respect to the meridian plane (on which they initially lie) a propulsion of the bar is obtained due to the friction between the surface of the rollers and the surface of the bar. At the same time the straightening effect of the rollers is also obtained.

In this way we obtain a simple straightening apparatus having the following advantages relatively to all existing bar straightening devices:

1. Very Good Straightening of the bar.
2. No damage of the surface of the bar or the ribs (in case of concrete reinforcing bar)
3. No damage of the rollers themselves due to rolling and not sliding friction which other straightening mechanisms use.
4. Propulsion of the bar simultaneously with the straightening effect without use of external feeding means. (i.e. separate sets of directly opposed rollers).
5. Minimization of the energy that is needed for straightening (It can be proved that the energy is at least half as much as that needed by the Rotor Bushings straightening machines).
6. The speed of the bar propulsion can be regulated by changing the angle of the roller planes. The rotor is rotating with a constant speed.
7. During the process, the bar does not rotate around its axis. It is kept without rotation. In such way the continuous straightening of a bar that comes out from coil is possible. (At all the existing bar straightening machines with stationary rollers, the bar must be a cut piece rotated around its axis during its propulsion through the machine).

The flying cutter provided in accordance with the present invention, is a common flying cutter, that obtains motion only by the contact with the metallic bar.

The cut pieces collector provided in accordance with the present invention, with minimal space requirements is a collector of cut bars that needs almost no space at all for the opening mechanism. It is explained below.

DETAILED DESCRIPTION OF THE PRESENTLY PREFERRED EXEMPLARY EMBODIMENT

Figure 1:
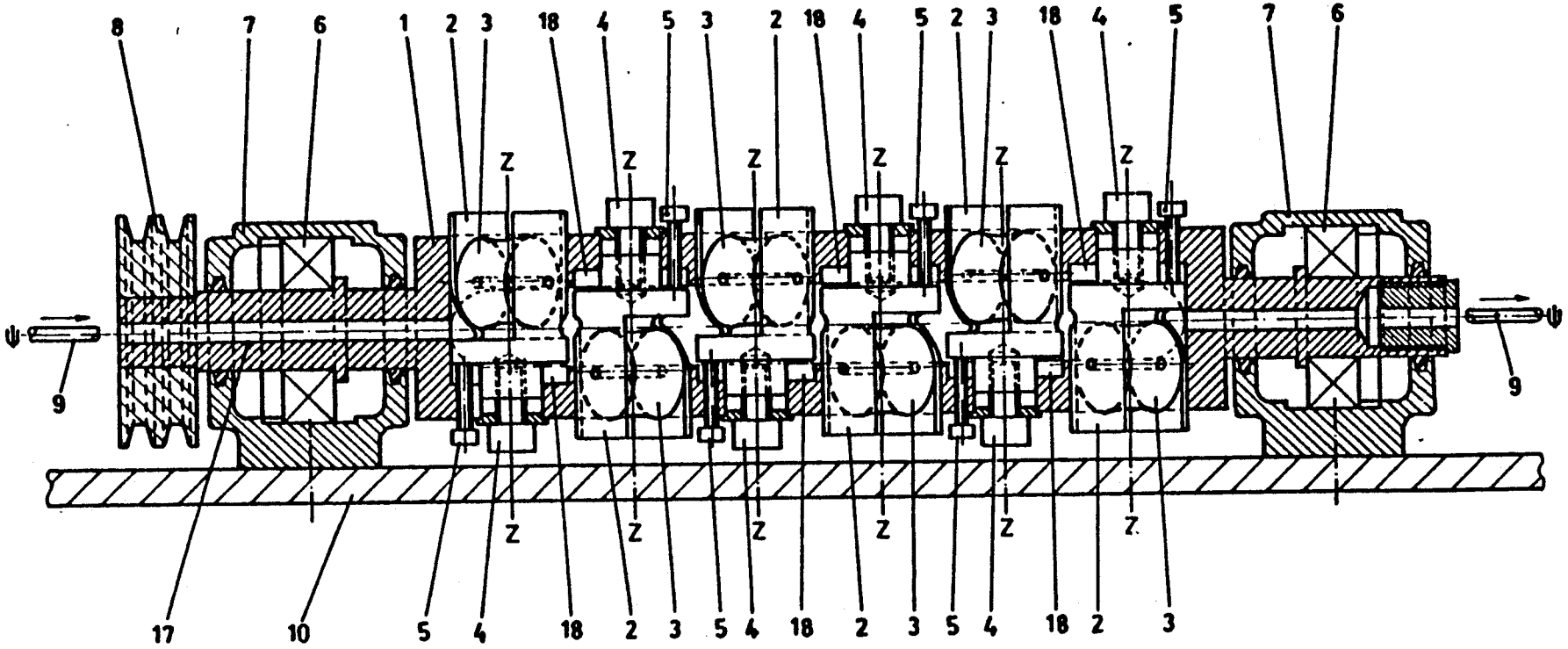
FIG. 1 is an elevational view, partly in cross-section, of the apparatus of the invention.

The main part of the apparatus is the Rotor (1), that is rotating about its axis ($\psi$—$\psi$), being supported by two Rollers or Ball Bearings (6). The rotation of the rotor is achieved through the V-belts pulley 8, via a number of V-belts and an electrical, hydraulic or other kind of motor (not shown). The bearings (6) are located in their housings (7) fixed on the machine base (10). The Rotor (1) has the following holes:

1. One hole (17) along its axis ($\psi$—$\psi$) for the passage of the bar
2. A number of Blind holes (18), as many as the rollers, for the roller location. (Usually: 5 or 6).

Figure 3:
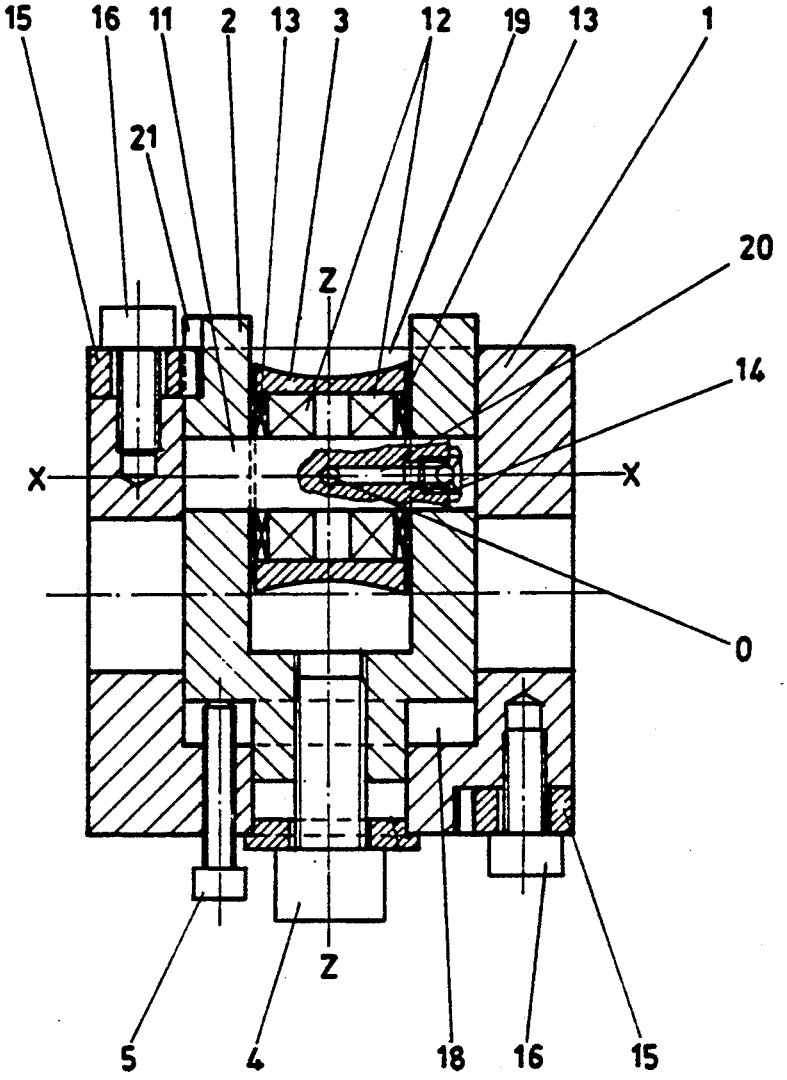
FIG. 3 is a cross-sectional view of the rotor.

The Cross-Section of the Rotor has a section that is symmetrical in respect to two perpendicular (between them) axes (Double Symmetry) FIG. 3, shows a rectangular rotor section which is currently preferred.

The second major assembly of the apparatus is the Rollers (3) with their (Roller) Carriers (2). The plurality of the Rollers is a number equal or greater than (3). Usually: 5 or 6).

The roller Carrier (2) is a cylindrical body with circular cross section. At one end of the cylinder, a chute (19) is formed into which the roller (3) is located and connected via the shaft (11). The roller (3) turns freely around its shaft (11), supported on that by two ball or roller bearings (12). These bearings are protected against the metallic dust by two Dust (Rotation) Sealings (13). The shaft (11) has on one of its ends a greaser (14), which brings grease to the bearings (12) through the hole (20), that is located on the center of the shaft (11).

The axis direction of the shaft (11) (X—X), is perpendicular to the axis (Z—Z) of the roller carrier (2), and these two axes meet each other at the point O.

The chute (19) is perpendicular to the plane (XOZ).

The external peripheral surface of the roller (3) is produced by the rotation around the axis (X—X), of a plane curve (initially located on the (XOZ) plane). That curve is symmetrical to the axis (OZ) and may be: hyperbola, parabola, Ellipse, part of a circle, two straight lines or other. In such way a groove is formed on the peripheral surface of the roller.

The roller carrier (2) has on its external cylindrical surface bevel gears (21). These are located on the same side of the cylinder that the chute is formed and serve for the rotation of the roller carrier (and consequently each roller and roller plane) relatively to the meridian plane.

At the other end of the roller carrier (2), a threaded hole (22) is defined on the (Z—Z) axis. This threaded hole (22) is for moving the roller carrier (2). (In order that the Roller (3) approaches the axis (Ψ—Ψ) of the rotor).

Figure 4A:
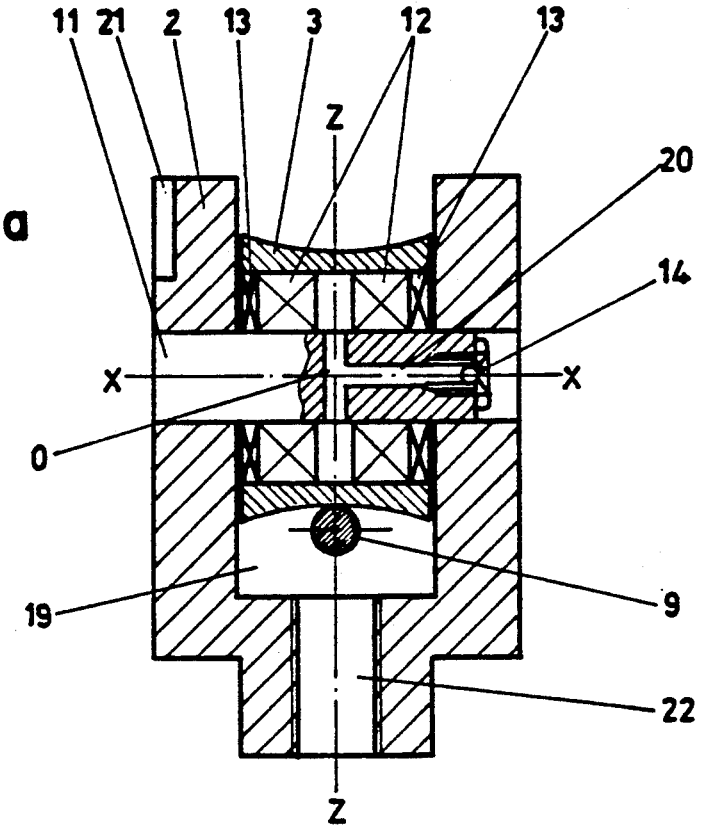
FIG. 4*a* is a view, partly in cross-section, of a roller carrier in accordance with the invention.
Figure 4B:
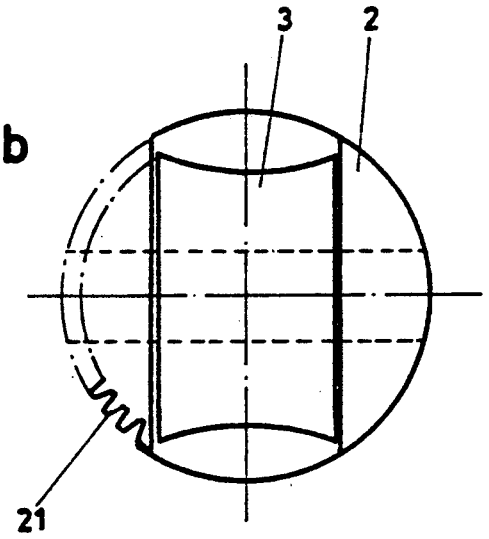
FIG. 4*b* is an axial view of a roller carrier in accordance with the invention.

The metallic bar (9) passes between the bottom of the chute and the surface of the roller (3), as one can see in FIG. 4.

The roller carriers (2), with their rollers (3) are located into the blind holes (18) of the Rotor.

Figure 2:
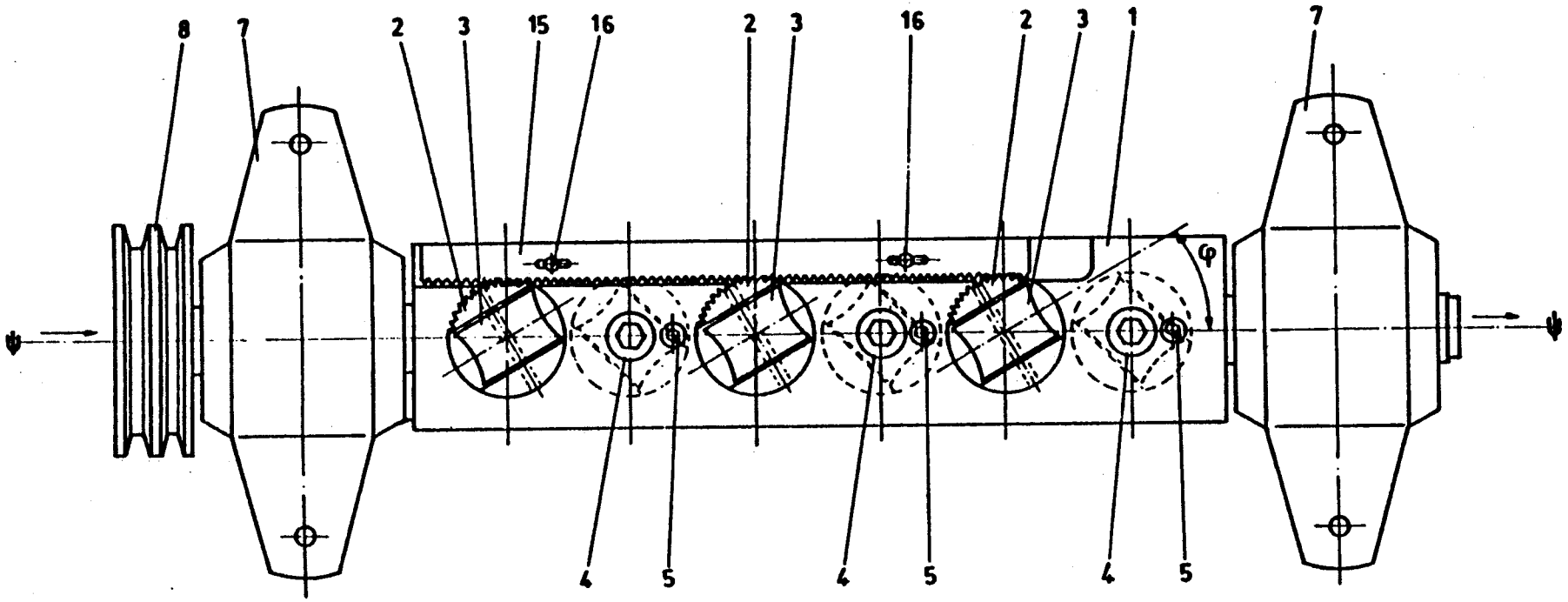
FIG. 2 is a top plan view of the apparatus of the invention.

Each roller Carrier (2) is located into its hole (18) and can be adjusted in two ways:

1. Displacement of the roller carrier in the direction of the (Z—Z) axis. The distance between the roller axis (X—X) and the rotor (Ψ—Ψ) can be increased or decreased. This adjustment is obtained by the pulling screw (4) and its counter (lock) screw (5).
2. Rotation of the roller and roller carrier around the (Z—Z) axis by increasing or decreasing the angle (9), as shown in FIG. 2. This adjustment is obtained via the Toothed Rule (15) and the Toothed Rule Screws (16). (In order to perform this adjustment, the toothed rule must be always engaged with the gears (21) of the roller carriers (2).

Figure 5:
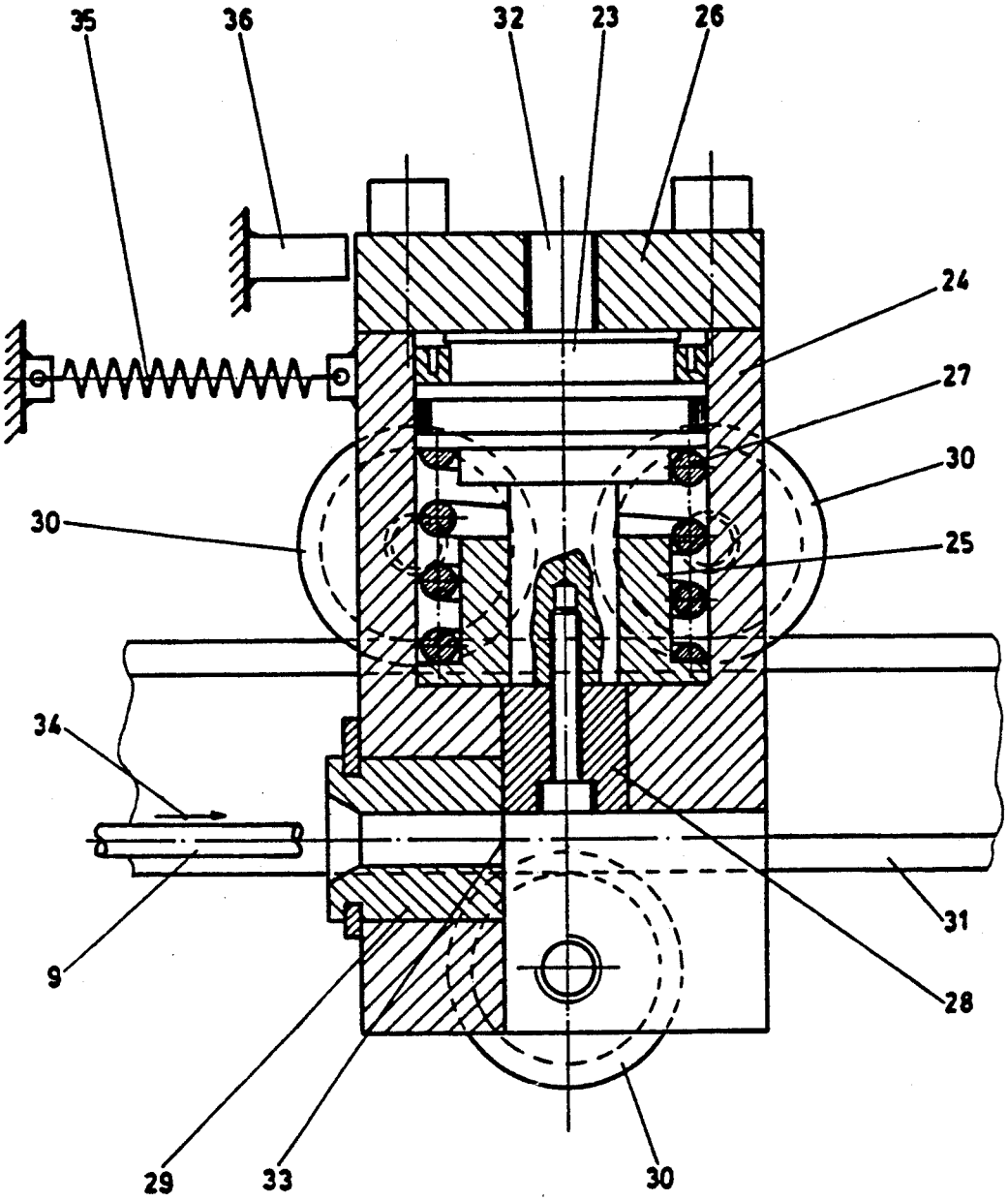
FIG. 5 is a sectional view of a flying cutter provided in accordance with the present invention.
Figure 6:
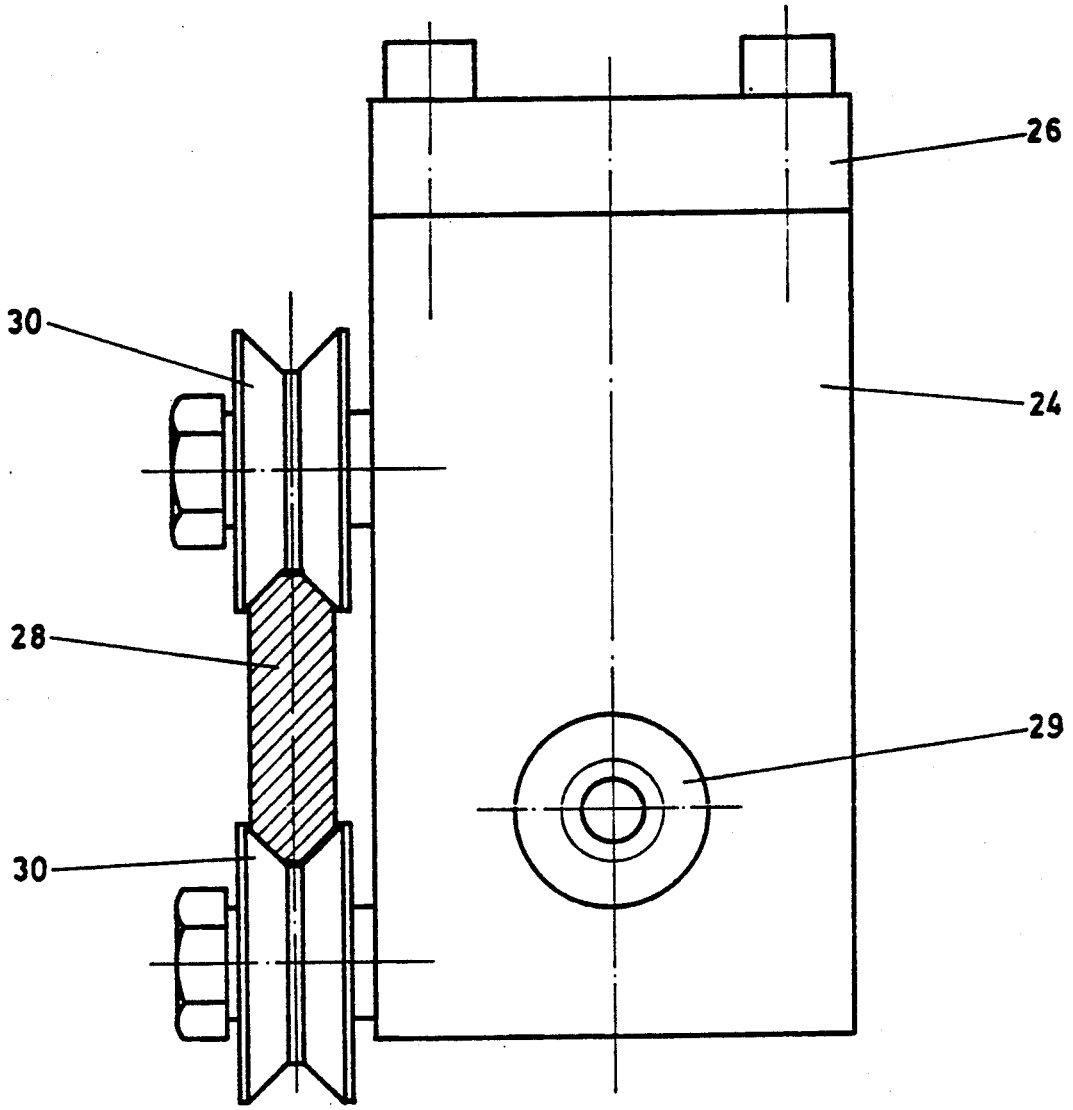
FIG. 6 is an elevational view of the flying cutter.

The flying cutter (shown in FIG. 5 and FIG. 7) consists of a piston (23) that is located into its cylinder-body (24), guided by the guide (25), enclosed into the cylinder body (24) by the cover (26), and returned on its upper position by the spring (27), the cylinder body (24), the moving knife (28), and steady knife (29), the support rollers (30) and the roller rail (31). When hydraulic pressure is exercised on piston (23), piston (23) pushes the moving knife (28) and cuts the bar (9) that passes through the hole of the steady knife (29), exactly at the plane (33). During the end, the cutter assembly moves as well along the direction shown by the arrow (34) on its rollers (30) and rail (31), following the motion of the bar (9) in the direction shown by the arrow (34).

After the cut, the piston returns to its initial position, the bar (9) is free to pas through the fixed knife. The cutter, pulled by the spring (35) returns to its initial position coming finally in contact with the stopping element (36). The cut pieces collector with minimal space requirements for the opening mechanism are shown in FIG. 7 and FIG. 8.

Figure 7:
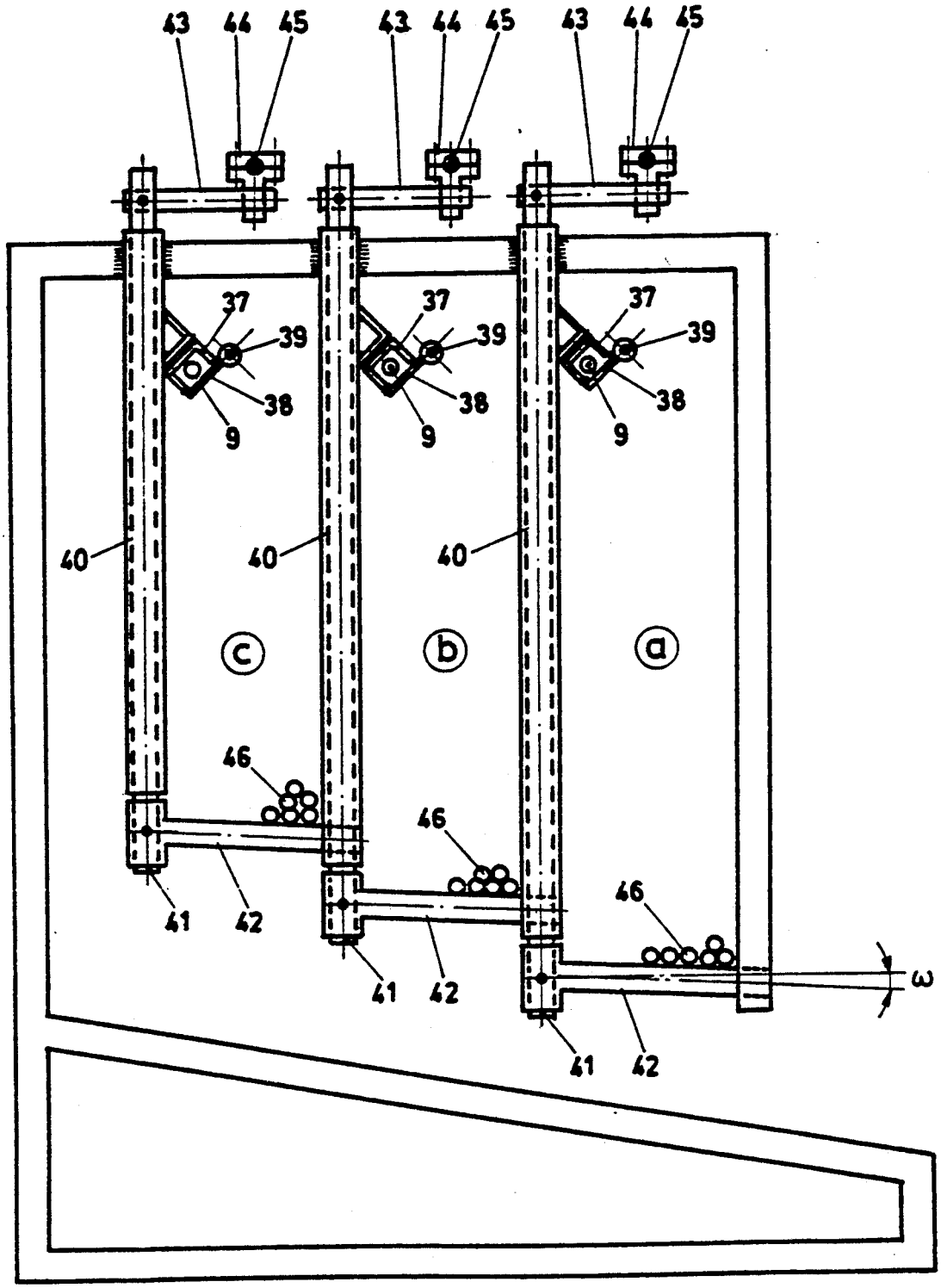
FIG. 7 is an elevational view of a cut pieces collector provided in accordance with the invention.
Figure 8:
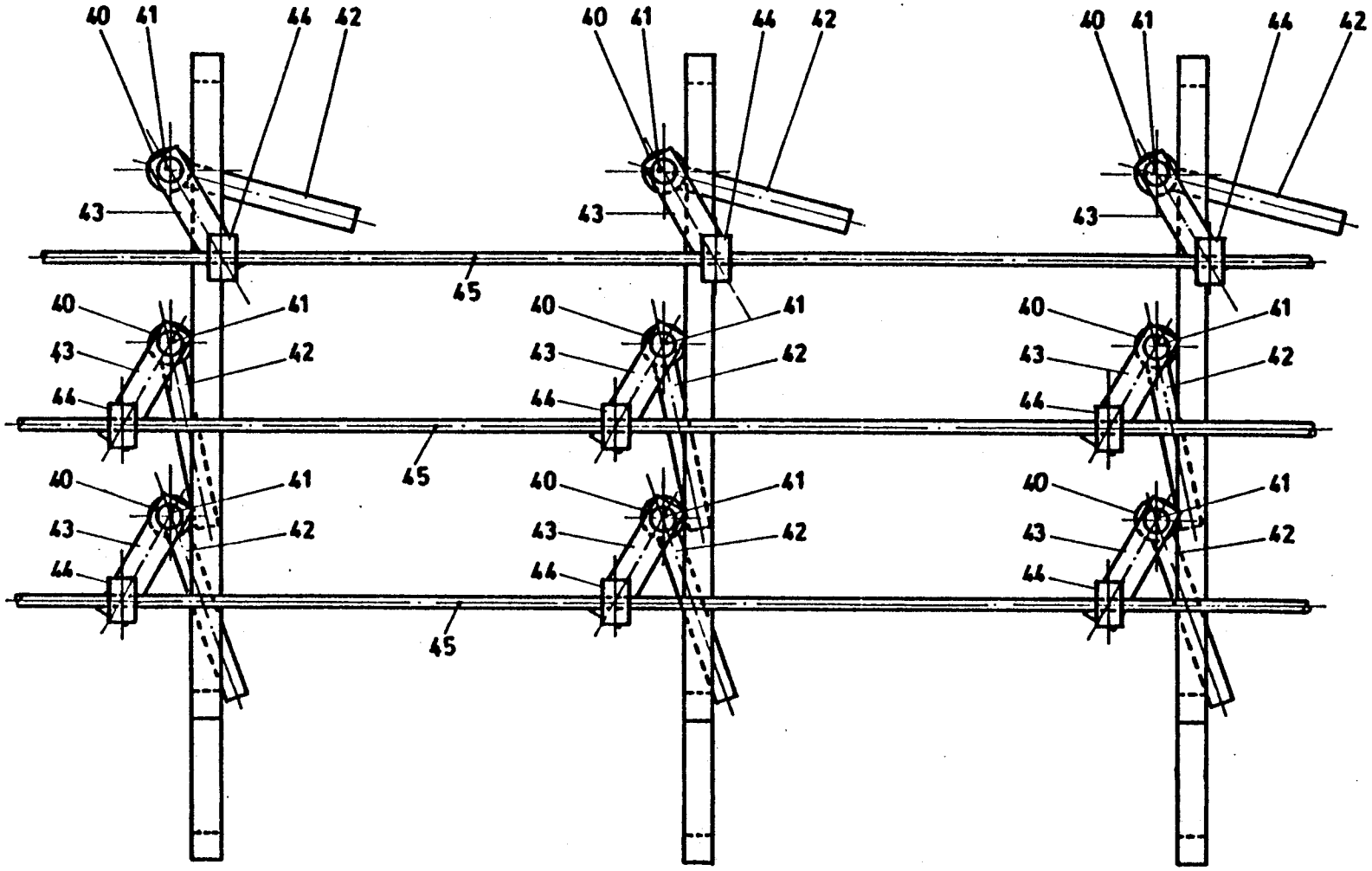
FIG. 8 is a top plan view of the collector of FIG. 7.

In FIG. 7, three such collector sub-systems are presented: (a), (b), (c). The number of the collector sub-systems can be altered but must be equal to the number of the rotors of the machine (one collector sub-system for each rotor). The bar (9), after its straightening, passes to a chute (37) that is closed with a blade (38). The blade (38) is used as a door, with hinges (39) in order to allow the cut bar to drop on the collectors (a) or (b) or (c).

Every collector is composed of a vertical pipe (40), a vertical axis (41), a closing door (42), and opening branch (43), a branch hinge (44) and opening bar (45).

At the "closed" position of the collector, the closing door (42) (that is only a bar), is in contact with the vertical pipe (40) of the following collector.

The cut bars (46) that drop on the collector are kept horizontally, supported by the door-bars (42). Of course the section that it is shown on FIG. 7 is repeated on length as many times as necessary for the length of the cut bars. For instance in order to create a 12 m collector we have to use nine stages (sections) having a distance between them of 1.5 m are used.

In order to open one of the collectors, for example, all the door bars (42) of part (a) have to be turned at the same time, using the opening bar (45). When the bar (45) is displaced in the direction of its axes by means of an actuator, (for example an air-piston), it moves simultaneously all the branches (43) of part (a) via the hinges (44).

Every branch (43) rotates around the axis (41), thus displacing the door bar (42) on the horizontal plane, from its initial position in contact with the following part's pipe (40) to a final position away from the pipe (40). In such a way a group of cut bars drops to the lower level for further elaboration (bundling, tying, etc). In order to facilitate the opening of the door-bars (42), an inclination with respect to the horizontal plane is applied to them.

The operation of the apparatus is described below:

1. The metallic bar is passed through the rotor channel (17), having all the Rotor carriers (2) loosened.
2. A desired angle (ϕ) for the roller carriers (2) is fixed via the toothed rule (15). The angle (ϕ) is as defined in FIG. (2). The value of (ϕ) is usually between 30° and 60°.
3. All of the Roller Carriers (2) are pulled by adjusting screws (4) and (5) light till bends (deformation) are created to the metallic bar.
4. The motor is placed in operation and consequently the rotor (1) is rotated. As the Rotor (1) rotates, the Rollers (3) tend to rotate spirally on the metallic bar's surface and if there is sufficient friction between the surface of the rollers (3) and the bar the bar is moved in the (Ψ—Ψ) direction.

The effect is exactly the same as if a system of a nut and bolt were provided. If we rotate the nut, not permitting its axial movement and if we keep the screw without any rotation, the screw will advance on its axis.

5. In order to improve the straightening effect and the bar propulsion some of the roller carriers (2) (or all of them) are further adjusted towards the rotor axis (X—X), keeping the same angle (ϕ). The rotation of the rotor is stopped and the roller carriers (2) are regulated by the screws (4) and (5) in order to obtain more pressure of the rollers on the points of contact with the bar. The deformation of the bar between the rollers is such that stresses that exceed the elastic limits of the bar material are created. These stresses pass into the plastic area where we have permanent deformations of the bar and finally the following is obtained:
   a) Excellent straightening effect
   b) Excellent propulsion action on the bar.

As already reported, the bar to be straightened must be kept without any rotation. If bar from a coil is used, the coil itself keeps the bar without rotation. For individual bars, external Rollers are used in order to restrain the bar from rotating.

6. The straightened bar passes through the flying cutter to a chute (37). As soon as a length counter measures the desired length of the bar, the cutter is activated. The cutter is free to move on rail (31), so during the cutting action it follows the bar (9) in the direction of its motion. After the cut, the cutter returns by the spring (35) to its initial position on its rail.

By using this type of flying cutter the following two advantages are obtained. (a) cuts without stopping the moving bar and (b) motion of the flying cutter only by means of the moving bar.

7. At the same time that the cutting is completed the door (38) of the bar chute (37) opens and the cut bar drops on the corresponding collector, (a), or (b), or (c). After a certain number of cut bars are accumulated, the collector is opened by means of the bar (45) and the cut bars group drops on a lower inclined surface for further processing.

I claim:

1. An apparatus for straightening elongated elements comprising:

a rotor having a longitudinal axis;

means for rotating said rotor about said logitudinal axis;

a plurality of rollers;

means for mounting said rollers to said rotor at spaced locations therealong, each said roller being mounted so as to be freely rotatable about a central axis thereof, each said roller being mounted so as to be pivotal about a pivot axis which is substantially perpendicular to said central axis so as to selectively vary an angle between a plane of said roller and a plane of said longitudinal axis of said rotor;

means for respectively adjusting a radial spacing of each said roller from said logitudinal axis of said rotor; and means operatively coupled to at least two of said rollers for simultaneously rotating said at least two rollers about said pivot axis to thereby predeterminately angularly orient said at least two rollers with respect to said logitudinal axis of said rotor.

2. An apparatus as in claim1, wherein said means for mounting includes roller carrier means, coupled to said roller and mounted to said rotor, said roller carrier means being radially adjustable with respect to the rotor axis to thereby adjust a radial spacing of each roller.

3. An apparatus as in claim 2, wherein each said roller is mounted to said respective roller carrier so that the longitudinal axis of the rotor is disposed between the roller and the mounting of the respective roller carrier to the rotor.

4. An apparatus as in claim 1, in combination with a flying cutter for cutting a predetermined length of wire straightened by the rotor.

5. The combination of claim 4, wherein said flying cutter includes means for cutting a bar straightened by the rotor, said cutter being movable in the direction of bar propulsion solely by the force of propulsion of the bar as said means for cutting cuts said bar.

6. The combination of claim 5, futher including means for returning said cutter to a precutting, rest position.

7. The combination of claim 5, further in combination with a cut bar collector having retaining bars which open by rotation on a horizontal plane.

8. An apparatus as in claim 1, wherein each said roller is mounted for rotation about said central axis by means of two roller bearings.

9. An apparatus as in claim 1, wherein an exterior peripheral surface is defined by a surface of rotation produced by rotating a curve which is symmetrical about an axial center of the roller about said central axis, said curve consisting of one of a part ellipse, an arc, a pair of angularly offset lines, and a parabola.

10. An apparatus for straightening elongated elements comprising;

a rotor having a longitudinal axis;

means for rotating said rotor about said longitudinal axis;

a plurality of rollers;

means for mounting said rollers to said rotor at spaced locations therealong, each said roller being mounted so as to be freely rotatable about a central axis thereof, each said roller being mounted so as to be pivotal about a pivot axis which is substantially perpendicular to said central axis so as to selectively vary an angle between a plane of said roller and a plane of said longitudinal axis of said rotor;

means for respectively adjusting a radial spacing of each said roller from said logngitudinal axis of said rotor; and a flying cutter including means for cutting a bar straightened by the rotor, said cutter being movable in the direction of bar propulsion solely by the force of propulsion of the bar as said means for cutting cuts said bar.

11. The apparatus of claim 10, further including means for returning said cutter to a precutting, rest position.

* * * * *